United States Patent [19]

Azimi

[11] Patent Number: 4,890,420

[45] Date of Patent: Jan. 2, 1990

[54] GRINDING MACHINE

[76] Inventor: Hossein Azimi, P.O. Box 781585, Wichita, Kans. 67278

[21] Appl. No.: 170,905

[22] Filed: Mar. 21, 1988

[51] Int. Cl.[4] ..... B24B 7/02

[52] U.S. Cl. ..... 51/122; 51/92 R; 51/240 A

[58] Field of Search ..... 51/121, 122, 283 R, 51/56, 240 A, 240 R, 231, 74 R, 91 R, 92 R, 110; 125/25, 35; 269/75, 60, 309; 198/861.1

[56] References Cited

U.S. PATENT DOCUMENTS

| | | | |
|---|---|---|---|
| 1,773,388 | 8/1930 | Canning | 51/56 |
| 2,869,292 | 1/1959 | Klugman | 51/122 |
| 3,805,456 | 4/1974 | Williams | 51/110 |
| 3,872,626 | 3/1975 | White | 51/240 A |

*Primary Examiner*—Frederick R. Schmidt
*Assistant Examiner*—Jack W. Lavinder
*Attorney, Agent, or Firm*—Rogers, Howell & Kaferkamp

[57] ABSTRACT

A grinding machine having a frame that supports an overhead grinder having a generally horizontal grinding wheel. Longitudinal beam assemblies are supported by the frame. The upper edges of the beam assemblies define inverted V guide tracks on which the wheels of a truck are supported. The truck has an upper deck that supports an object to be ground. The beam assemblies are supported from the frame by universal mounted adjustable legs. Cam and cam follower connections between the beam assemblies and the frame restrict lateral movements and maintain the alignment of the beam assemblies as they are vertically adjusted by the adjustment of the adjustable legs. The adjustment of the beam assemblies allows the tracks to be set parallel to one another defining an inclined plane. The truck has wheels on adjustable bearings so the deck will remain parallel to the grinding surface of the grinding wheel to be ground.

25 Claims, 3 Drawing Sheets

GRINDING MACHINE

BACKGROUND OF THE INVENTION

This invention is directed to a grinding machine and particularly to a grinding machine used to grind a flat surface to extremely close tolerance parallel to another surface on a concrete or stone block member.

In the kind of grinding machine to which this invention relates, a grinder is incorporated. There are several commercially available grinders that are constructed with precision spindles and capable of extremely accurate surface grinding. These grinders incorporate grinding wheels designed to grind on the cylindrical surface or on the flat face of the wheel. Typically, the objective is to grind a perfectly flat surface or an object. To grind the entire surface of an object, the grinding wheel is moved relative to the object. This may be accomplished by moving the grinding wheel or by moving the object and holding the grinder stationary. In order to maintain a precisely flat ground surface within close tolerances, it is necessary that the moving part, either the grinder or the block to be ground, be moved in a precisely defined plane.

The known grinding machines accomplish relative movement between the object and the grinder on three dimensional axes. However, these known grinding machines have not achieved sufficient accuracy in maintaining this relative movement within a precise plane. Typically, in order to achieve a flat ground surface, the area of contact with the grinding wheel is reduced, such as to a line of contact between the object and the cylindrical surface of the grinding wheel. This approach greatly increases grinding time and is too expensive for many applications, such as the grinding of concrete or stone modular blocks.

Modular blocks are examples of products on which these grinding machines are used. Such modular blocks are cast of concrete and are adapted for assembly in face-toface relationship such that, when held together by tension rods, the modular block assembly forms a structural member such as a beam or a column. Examples of some of these modular blocks are described and illustrated in Azimi U. S. Pat. No. 4,694,629. The contacting faces of these modular blocks must be flat within extremely close tolerances and must be exactly parallel so that they fit tightly and accurately together across the entire contacting faces so that forces and loads will be transferred uniformly from one block to another.

In the casting of these modular blocks, the mold has precisely formed surfaces, but the faces of a molded block are not flat within the required 0.0005 inch tolerance. Therefore, it is necessary that these faces be ac curately ground by a grinding machine. However, no grinding machine has been developed heretofore that compensates for wear on the grinding surface of the grinding wheel while accurately supporting a concrete or stone block to achieve a ground surface within the desired tolerances of no more than 0.0005 inch and do so within an acceptable period of time.

Therefore, the general object of this invention is to provide a grinding machine that is of rigid structural construction, that has an accurately supported truck movable to move a block to be ground relative to the grinding wheel, and that has precisely controlled adjusting means for accurately establishing the path of movement of the truck so that the surface to be ground is set in precisely the desired plane.

SUMMARY OF THE INVENTION

This grinding machine incorporates a frame that supports a vertically movable grinder. The grinder has a rotating grinding wheel that preferably incorporates a flat grinding surface to maximize the contact area between the grinding surface and the object. The frame also supports two spaced longitudinally extending beam assemblies. The beam assemblies are of composite construction and incorporate upper edges bevelled to form longitudinal inverted V guide tracks. The ends of each beam assembly are supported on legs that are adjustable to precisely adjust the beams relative to the frame. The adjustable legs are formed with ball and socket connections to the frame and pivot connections to the beams.

There are cams and cam followers between the beam assemblies and the frame so that, as the lengths of the legs are adjusted, the cams and cam followers cause the beam assemblies to track controlled paths and they hold the beam assemblies firmly in the adjusted parallel positions. The adjustments of the beam assemblies allow the longitudinal tracks to be precisely adjusted to be parallel and to define a precisely selected plane. This plane is inclined at an angle that compensates for the rate of wear on the grinding surface of the grinding wheel.

A truck has wheels mounted on adjustable bushings that ride on the inverted V guide tracks and has a top deck for supporting an object to be ground. The adjustable bushings permit the deck to be set so that it is parallel to the grinding surface of the grinding wheel, compensating for the angle of the beams. As the truck moves on the longitudinal tracks, the object is moved relative to the grinding wheel. The precise adjustments to the beam assemblies which thereby adjust the orientation of the tracks and the precise adjusmments of the bushings allows very accurate setting of the plane of movement of the truck deck parallel to the grinding surface. This allows precise control of the plane of movement of the face of the object while it is being ground and while compensating for wear on the grinding wheel.

DETAILED DESCRIPTION OF PREFERRED EMBODIMENT

Figure 1:
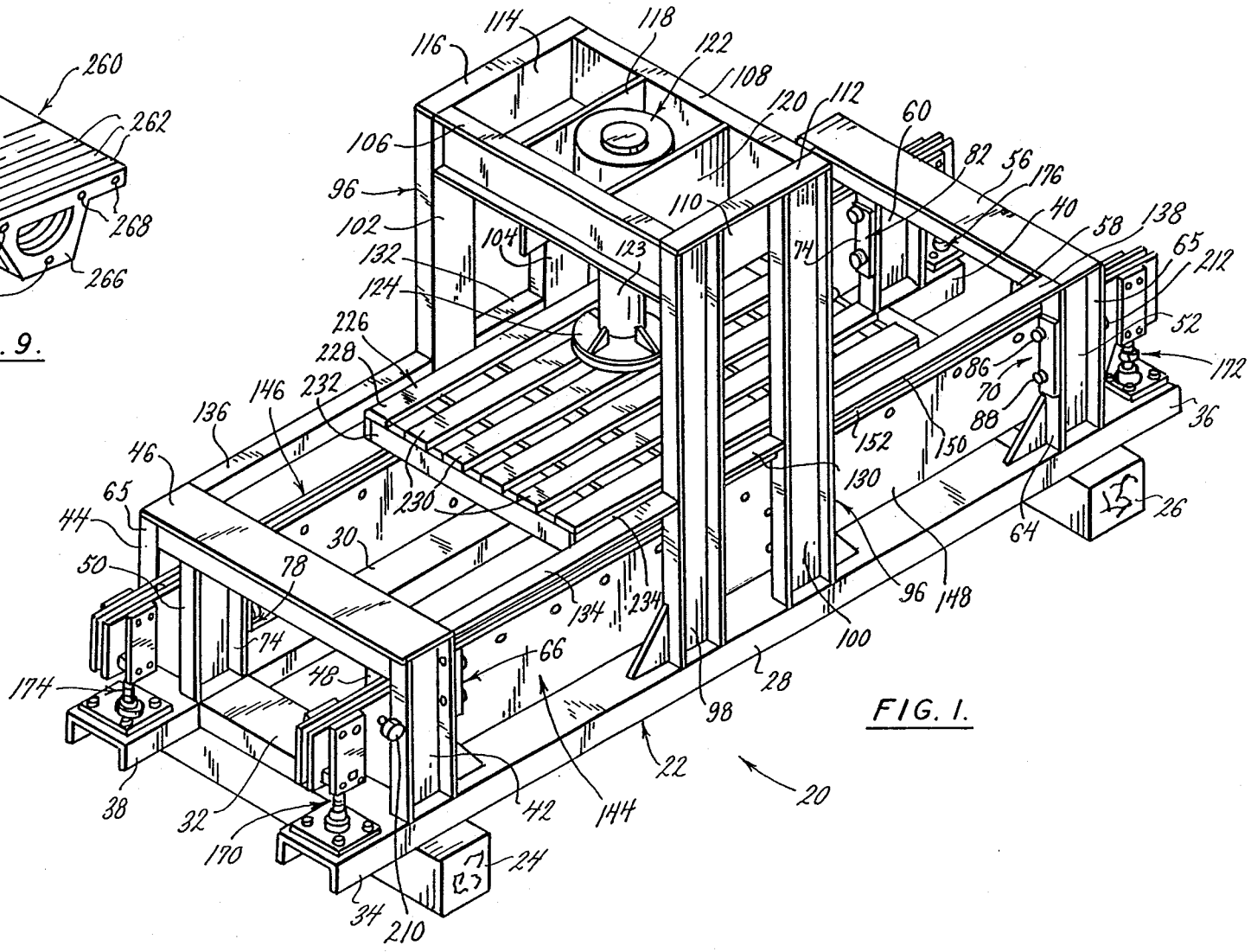
FIG. 1 is a perspective view of the grinding machine.

This grinding machine 20 includes a frame 22 that rests firmly upon blocks 24 and 26 that are on the floor of a building. All components of the frame are of steel rigidly joined together, such as by welding, and incorporating appropriate gusset plates, so that the frame is unitized, rigid and stable. The frame 22 includes two longitudinally extending base members 28 and 30 extending between the left and right ends of the frame and transverse base members 32 and 33 welded to and extending front to rear between the longitudinal base members 28 and 30.

The longitudinal base member 28 has end sections 34 and 36, and the longitudinal base member 30 has end sections 38 and 40. The end sections 34, 36, 38 and 40 are to the left and right, as appropriate, of the transverse base members 32 and 33. Adjacent the end sections 34 and 38, there are outboard upright channel members 42 and 44 welded to the longitudinal base members 28 and 30. A cross channel member 46 is welded to the upper ends of the outboard upright channel members 42 and 44 to provide strength and rigidity. Spaced inwardly from the upright channel members 42 and 44, there are two inboard upright channel members 48 and 50 welded between the respective longitudinal base members 28 and 30 and the upper cross channel member 46.

At the right end of the grinding machine 20, as viewed in the drawings, and adjacent the end sections 36 and 40, there are two outboard upright channel members 52 and 54 welded to the longitudinal base members 2S and 30. A cross channel member 56 is welded to the upper ends of the outboard upright channel members 52 and 54. Inboard upright channel members 5B and 60 are welded between the respective longitudinal base members 28 and 30 and the cross channel member 56.

Each outboard upright channel member 42, 44, 52 and 54 has an inner flange 64 and an outer flange 65. Cam follower assemblies 66, 68, 70 and 72 are mounted on the inner flanges 64 of the respective outboard vertical channel members 42, 44, 52 and 54.

Figure 8:
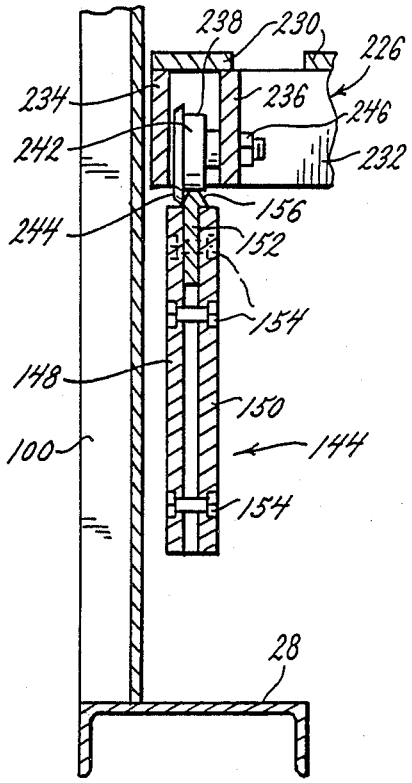
FIG. 8 is a right end elevation view of the grinding machine as viewed from the right of FIG. 2, with parts shown section.

The inboard vertical channel members 48, 50, 58 and 60 also have outer and inner flanges 73 and 74. Cam follower assemblies 76 (Fig. 8), 78, 80 (FIG. 8) and 82 are supported by the inner flanges 74 of the respective inboard vertical channel members 48, 50, 58 and 60.

Each of the cam follower assemblies 66, 68, 70, 72, 76, 78, 80 and 82 comprises a plate 84 on which upper and lower cam follower rollers 86 and 8S are rotatably supported. Each block 84 is mounted by bolts 90 in transversely elongated slots 92 (se FIG. 7) so that the blocks 84 are transversely adjustable in position and can then be locked in an adjusted position by the bolts 90.

Centrally of the frame 22, there is a grinder support assembly 96. The grinder support assembly 96 comprises a pair of upright columns 98 and 100, welded to and extending upwardly from the longitudinal base member 28, and another pair of upright columns 102 and 104 welded to and extending upwardly from the longitudinal base member 30. Transverse cross members 106 and 108 are welded between the upright columns 98 and 102 and between the vertical columns 100 and 104, respectively.

In addition, there are reinforcing end plates 110 and 112 welded between the upright columns 98 and 100 and reinforcing end plates 114 and 116 welded between the upright columns 102 and 104. Inner support plates 118 and 120 are welded between the transverse cross members 106 and 108 and this framework supports a grinder 122. The grinder 122 is of a conventional design that has a spindle 123 supporting a grinding wheel 124 rotatable on a vertical axis and that has means (not shown) to selectively adjust the vertical position of the grinding wheel 124. The grinding wheel has a flat grinding surface 125 (Fig. 2) that can perform a grinding operation upon rotation of the grinding wheel 124. Because the flat surface 125 is the grinding surface, a relatively large grinding area is presented by the surface 125, increasing the grinding rate and reducing the number of passes required to grind a surface of an object.

For reinforcement, a longitudinal support member 130 (FIG. 1) is welded between the vertical columns 98 and 100 and a similar longitudinal member 132 is welded between the vertical columns 102 and 104. A longitudinal support member 134 is welded between the upright channel 42 and the vertical column 98, and a longitudinal support arm 136 is welded between the upright channel 44 and the vertical column 102. Similar reinforcing members 138 and 140 (FIG. 8) are welded between the upright channel member 52 and the upright column 100, and between the upright channel member 54 and the upright column 104.

Appropriate reinforcing gussets are also installed at various places, and the overall frame 22 is sufficiently strong and rigid to remain steady against the vibrational forces of a grinding operation.

Figures 2, 4, 5, 7:
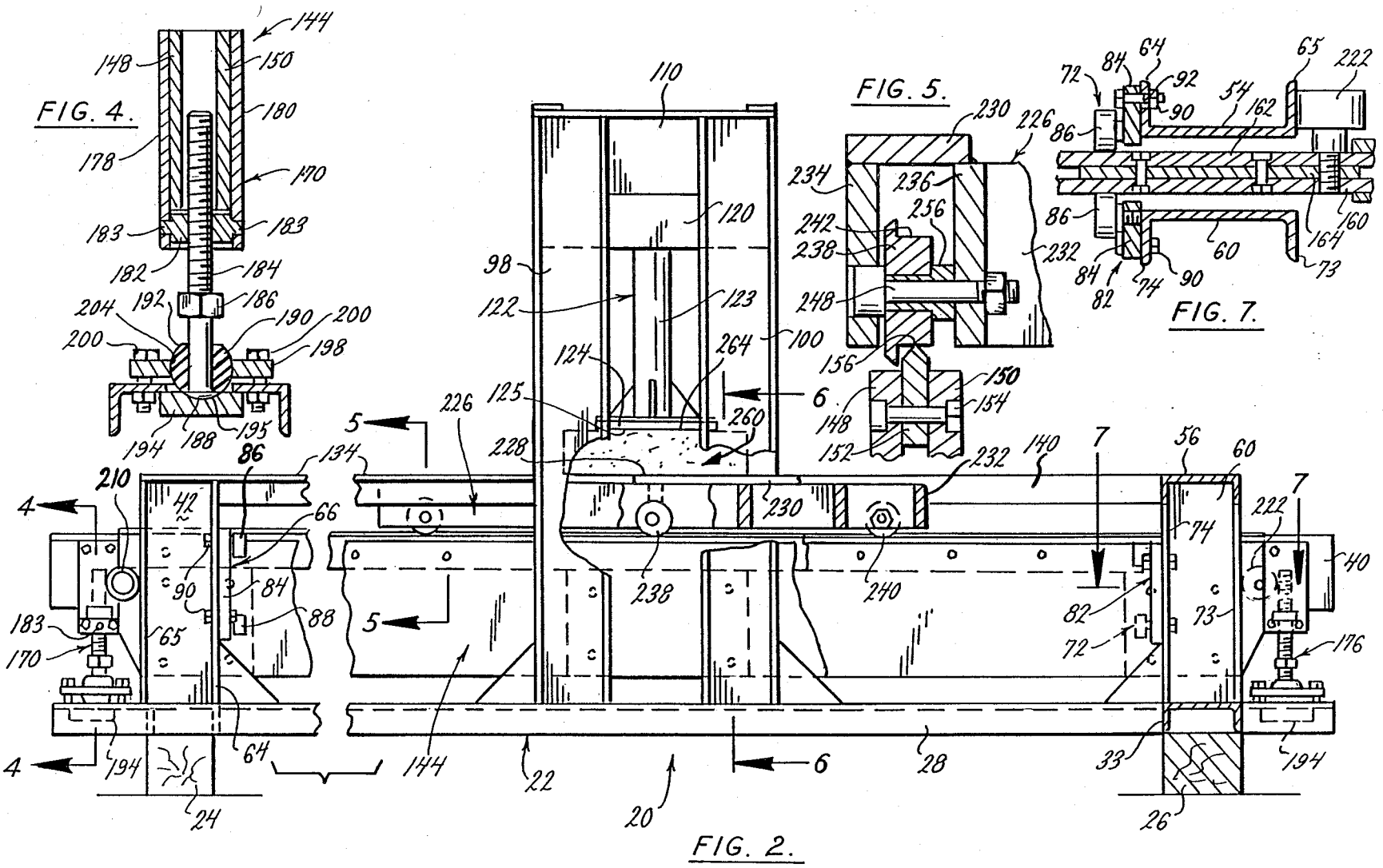
FIG. 2 is a front elevation view of the grinding machine with parts broken away and parts shown in section.
FIG. 4 is an elarged view in section taken along the plane of 4—4 of FIG. 2.
FIG. 5 enlarged view in section taken along the plane line 5—5 of FIG. 2.
FIG. 7 is an enlarged view in section taken along the plane line 7—7 of FIG. 2.

On opposite sides of the grinding machine 20, there are composite beam assemblies 144 and 146. As particularly shown in FIG. 6, the beam assembly 144 comprises two plates 148 and 150 sandwiched on opposite sides of a track 152. The plates 148 and 150 are held together by rows of bolts 154 with the uppermost row of bolts extending through the track 152. The track 152 is elongated, extending at least to the cross channel members 46 and 56, and the track 152 has a tapered upper edge that defines an inverted V guide 156 as illustrated in FIG. 5.

Similarly, the beam assembly 146 includes two plates 160 and 162 (FIGS. 7 and 8) sandwiched on opposite sides of a track 164 that also has a bevelled upper edge defining an inverted V guide 166. Both inverted V guides are straight within a tolerance of 0.0005 inch and are of at least 62–65 Rockwell C.

The beam assembly 144 is supported at its opposite ends from the frame 22 by a pair of adjustable leg assemblies 170 and 172, and the beam assembly 146 is supported from the frame 22 by a similar pair of adjustable leg assemblies 174 and 176. An example of these adjustable leg assemblies is shown in FIG. 4. The leg assembly 170 shown includes a pair of cover plates 178 and 180 bolted to the outer faces of the beam plates 148 and 150. An internally threaded nut 182 is pivotally connected by bearings 183 to the cover plates 178 and 180, and a threaded stud 184 is threaded through the nut 182. Because the nuts 182 are pivotally mounted, the studs 184 can swing about the bearings 183 in longitudinal planes. A hex head 186 is fixed to the stud 184 so that the stud can be turned by a wrench. The stud 184 has a hard steel head 188 that, in combination with an elastomeric bushing 190, defines a spherical bearing member 192.

A hard steel bearing plate 194 is welded to the longitudinal channel member 28 below an opening 196. The bearing plate 194 has a polished concave bearing surface 195 shaped as a segment of a sphere, and the bearing member 192 rests upon and can rotate with respect to the bearing surface 195. A plate 198 is fastened by bolts 200 to the longitudinal channel member 28. The plate 19 has an annular bearing opening 204 through it that is shaped as a segment of a sphere to receive the bushing 190.

Adjacent opposite ends of the beam assembly 144, two cam follower rollers 210 and 212 (FIG. 1) are journalled on bearings (not shown) and supported by the outer plate 148 of the beam assembly 144. These cam followers 210 and 212 are in contact with the outer flanges 65, respectively, on the outboard upright channel members 42 and 52, respectively. There is a similar cam follower roller 218 on the beam assembly 146 in contact with an outer flange 65 (FIG. 3) on the outboard upright channel member 44, and a like cam follower roller 222 (FIG. 7) in contact with the outer flange 65 on the outboard upright channel member 54.

As shown in FIGS. 1 and 2, a truck 226 has a flat horizontal deck 228 for supporting an object to be ground. The deck 228 may be formed of parallel steel slats 230 supported on a truck frame 232.

Figure 6:
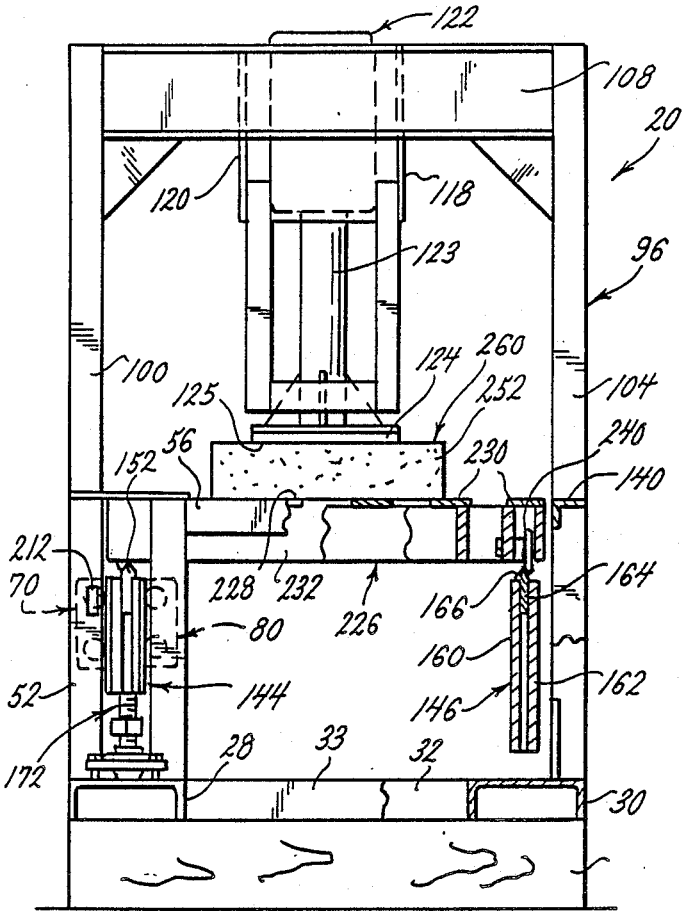
FIG. 6 is an enlarged view in section taken along the plane of line 6—6 of FIG. 2.
Figure 3:
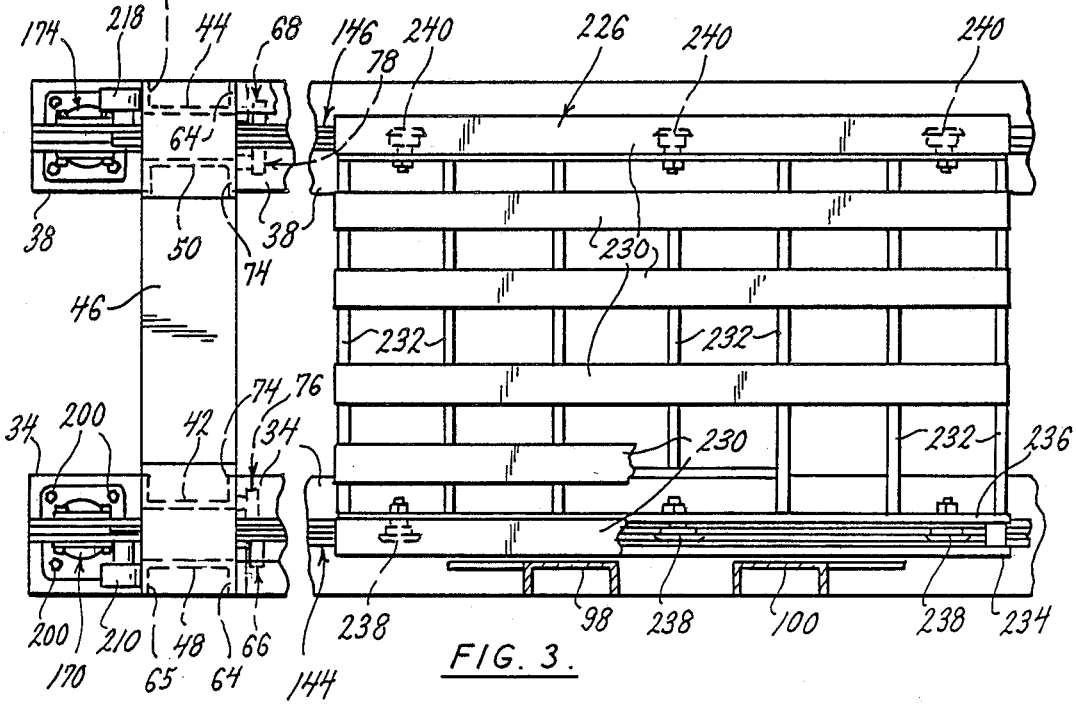
FIG. 3 is a top plan view of the grinding machine with parts away and parts shown in section.

The frame 232 of the truck 226 includes parallel longitudinal ribs 234 and 236 on each front and rear side (see FIGS. 3 and 6). The truck has three front wheels 38 and three rear wheels 240, and FIG. 6 shows how these wheels 238 and 240 are mounted and how they are formed. As shown in FIG. 6, each wheel 238 and 240 is journalled on a rib 236 and each wheel 238 and 240 has a cylindrical follower surface 242 and an outer extending retainer section 244. The follower wheel 242 rides on an inverted V guide 156 or 166, and the radial retainer section 244 restricts movements of the truck 226 transversely relative to the inverted V guide 156 and 166.

The wheels 238 are mounted on a rib 236 by mounting and tightening devices 246 that allow the wheels 238 to be aligned in a straight row. Similarly, the wheels 240 can be aligned in a straight row parallel to that of the wheels 238. Each wheel 238 and 240 is mounted on a stationary adjustable bearing 256 (FIG. 5) of the known kind that has an eccentric mounting hole through which the wheel mounting shaft 248 extends. When the bushing 256 is rotated and tightened in place, the elevation of the shaft 248 and its wheel 238 or 240 can be precisely set relative to the truck frame 232. This permits compensation for any error in manufacture of the truck and components and provides a way to precisely compensate for wear on the grinding surface 125 during a grinding pass, as will be described hereinafter.

Figure 9:
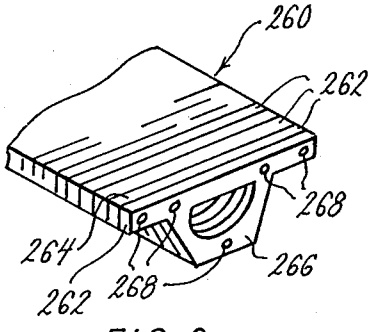
FIG. 9 is a perspective view of part of a beam formed by an assembly of modular blocks.

FIG. 9 illustrates a typical beam assembly 260 formed by an assembly of a plurality of modular blocks 262. Each block 262 has opposed parallel faces 264 and 266, and these faces 264 and 266 are pressed together in mutually facing relationship when the assembly of blocks 262 is held together by appropriate tension rods 26S in a manner known in the art.

Typically, these blocks 262 are cast. In casting, the faces 264 and 266 of the blocks 262 are not flat and parallel within the necessary tolerance. These faces 264 and 266 must be ground to a plane that is within tolerances as fine as 0.0005 inch so that the blocks 262 will fit together properly in the beam assembly 260.

Operation

The accuracy of this grinding operation is attained by the accuracy of the means for adjusting the beam assemblies 144 and 146 and by the inverted V guides 156 and 166 on which the wheels 238 and 240 of the truck 226 roll. Since the adjusting means, comprising the leg assemblies 170, 172, 174 and 176 have universal joint connections represented by the part-spherical heads 188 bearing on the concave bearing surfaces 195, vertical adjustments of the legs 184 are accomplished with no binding. These universal connections together with the pivot bushings 183 provide a "floating" support for the beam assemblies 144 and 146.

The cam followers 86 and 88 of the cam assemblies 66, 68, 70 and 72, and the cam assemblies 76, 78, 80 and 82 hold the beam assemblies 144 and 146 in constant vertical alignment. The cam followers 210, 212, 218 and 222 also maintain constant contact with the flanges 65 on the respective upright channel members 48, 52, 44 and 54. These cam and cam follower assemblies restrict longitudinal movements of the beam assemblies 144 and 146.

The legs 184 are adjustable to set the beam assemblies 144 and 146 precisely as desired. In the set positions, the inverted V guides will be exactly parallel and they will define a plane that is inclined upwardly in the direction of a grinding pass. This upward inclination is at an angle calculated to raise the truck 226 steadily and gradually during a grinding pass to compensate for wear of the grinding surface 125 during the grinding pass.

After the beam assemblies 144 and 146 are set, the adjustable bearings 256 of the truck 226 are rotated to set the wheels 238 and 240 to precise elevations relative to the truck frame 228. At these precise elevations, the deck 230 of the truck is exactly parallel to the face of the grinding surface 125. Thus, the adjustable bearings 256 allow compensation for the inclination of the inverted V guides 156 and 166 so that the truck deck will remain parallel to the grinding surface as the truck gradually rises during a grinding pass.

During adjustment of the beam assemblies 144 and 146, the cam follower assemblies 66, 68, 70, 72, 76, 78, 80 and 82 restrict lateral movement of the beam assemblies while the cam follower rollers 210, 212, 218 and 222 restrict longitudinal movement of the beam assemblies 144 and 146. Since adjustment of the legs 184 results in changing the elevation of one end of a beam assembly 144 or 146 relative to its other end, the angles of the legs 184 to their respective beam assemblies change as the legs 184 are adjusted (rotated in the threaded nuts 182). However, the pivotal connections afforded by the bearings 183 and the universal supports provided by the stud heads 188 allow the beam assemblies 144 and 146 to "float" and accommodate these angle changes.

To be ground, an object, such as a block 262 is placed upon the deck 228 of the truck 226. When the truck is moved past the grinding wheel 124, such as from left to right, a grinding pass is made on the face 266 of the block 262. If the block is wider than the grinding wheel 124, as is usually the case, the block can be moved transversely for a subsequent pass until the face 266 is ground to a flat condition within a close tolerance of no more than 0.0005 inch. Significantly, the relatively broad grinding surface 125 reduces the number of passes required to grind the face 264.

There are various changes and modifications which may be made to the invention as would be apparent to those skilled in the art. However, these changes or modifications are included in the teaching of the disclosure, and it is intended that the invention be limited only by the scope of the claims appended hereto.

What is claimed is:

1. A grinding machine comprising a stationary base frame and two relatively movable members, a first member comprising a grinder having a grinding wheel with a grinding surface on the grinding wheel, means for supporting the grinding wheel from the base frame with the grinding surface in predetermined orientation relative to the base frame, a second member comprising a deck for supporting an object to be ground, means for supporting the deck from the base frame, wherein the means for supporting the deck comprises a plurality of supporting means having movable elements allowing movement of the second member relative to the first member to establish a grinding pass between the grinding surface and the object, said means for supporting the deck from the base frame comprises two beams assemblies supported from the base frame and having tracks thereon, wherein the plurality of supporting means comprise wheels which are supported on the tracks, means for adjusting the relative angular orientation of the grinding surface and the deck to maintain them in planes that are parallel to one another, a means for adjusting the beam assemblies relative to the base frame to locate the tracks parallel to one another and inclined relative to said planes, a means for adjusting the wheels relative to the second member so that the planes are parallel in spite of the inclination of the tracks, and means for decreasing the distance between the planes in proportion to wear on the grinding surface during movement of the second member relative to the first member in a grinding pass between the grinding surface and the object.

2. The grinding machine of claim 1 wherein the movable second member comprises a truck that carries the deck.

3. The grinding machine of claim 2 wherein the grinding wheel is vertically adjustable relative to the base frame.

4. The grinding of claim 1 wherein the grinding machine has a spindle for supporting the grinding wheel, and the grinding surface is flat and is normal to the spindle.

5. The grinding machine of claim 1 including legs for connecting the beam assemblies to the base frame, the means for adjusting the beam assemblies including means for adjusting the length of each leg, each leg having an end connection to a beam assembly and an end connection to the base frame, one end connection comprising pivot means and the other end connection comprising a universal joint.

6. The grinding machine of claim 1 wherein the tracks define inverted V shaped guides and the wheels are supported on the pieces of the inverted V guides.

7. A grinding machine comprising a base frame, a pair of beams, means for supporting the beams for universal movement relative to the base frame and means for restricting such movement, a pair of elongated tracks supported by the upper sides of the beams, means for adjusting the supporting means to locate the tracks parallel to one another, a grinding wheel assembly supported by the base frame spaced above the tracks and having a downwardly depending grinding means, a truck having a deck for supporting a part to be ground, a plurality of wheels in parallel rows on the truck for riding on the tracks to support the truck with the deck positioned below the grinding wheel.

8. The grinding machine of claim 7 wherein the means for supporting the beams comprises at least four upright leg members each having an upper end and a lower end, pivotal connection means between each upper end and a beam, universal connection means between the lower end of each leg member and the base frame, and means for independently adjusting the length of each leg member.

9. The grinding machine of claim 8 wherein each leg member includes a threaded shaft, an internally threaded member supported by a beam for receiving a threaded shaft, whereby threading the threaded shaft relative to the threaded member alternately extends and reduces the length of threaded shaft between the beam and the base frame.

10. The grinding machine of claim 7 wherein the tracks comprise hardened steel inverted V guides and the wheels are of hardened steel and ride upon the inverted V guides.

11. The grinding machine of claim 10 including eccentric brushings connected between the wheels and the truck for vertical adjustability of the wheels.

12. The grinding machine of claim 7 including guide means for restricting lateral movement of the beams while permitting vertical adjustments of the positions of the beams.

13. The grinding machine of claim 7 wherein the grinding means is vertically movable relative to the truck deck.

14. A grinding machine comprising a frame, a grinding wheel assembly, means for supporting the grinding wheel assembly from the frame, the grinding wheel assembly having a grinding wheel for grinding in a plane, a pair of beams supported for universal movement from the frame, a pair of tracks supported by the beams, means for adjusting the beams relative to the frame so that the tracks define a plane inclined to the grinding plane, truck for supporting a part to be ground, and a plurality of vertically adjustable wheels on the truck engageable with the tracks for supporting the truck thereon, and means for adjusting the wheels.

15. The grinding machine of claim 14 wherein the tracks are of hard material with straight inverted V shaped guides in contact with the wheels.

16. The grinding machine of claim 14 wherein the beam adjusting means includes universal joint connections between the beams and the frame.

17. The grinding machine of claim 16 including means for adjusting the lengths of the universal joint connections.

18. The grinding machine of claim 14 including vertical guides between the frame and beams to restrict lateral movements of the tracks while permitting vertical movements thereof.

19. The grinding machine of claim 18 wherein the vertical guides include means supported by one of the frame or beams defining fixed vertical surfaces and rollers supported by the other of the frame or beams and bearing against the fixed surfaces.

20. The grinding machine of claim 19 wherein the rollers and fixed surfaces are oriented to restrict movements of the tracks in any horizontal direction.

21. A grinding machine comprising a frame, a truck movably supported by the frame, a grinder supported by the frame and having a grinding wheel spaced above the truck for grinding contact with an object resting on the truck, the frame having means defining bearing surfaces on which the truck is movably supported, means for adjusting the plane of said bearing surface means, and means to restrict lateral movements of the bearing surface means during operation of said adjusting means.

22. The grinding machine of claim 19 including cam and cam follower connections between the bearing surface means and the frame for restricting movements of the bearing surface means to vertical directions.

23. The grinding machine of claim 19 wherein the bearing surface means comprises two beams, four vertical columns projecting upwardly from the frame and having flat cam surfaces vertically oriented, and cam followers supported by the beams in contact with the cam surfaces.

24. The grinding machine of claim 23 wherein the cam surfaces and cam followers are oriented at ninety degrees to one another.

25. The grinding machine of claim 24 wherein the upper edges of the beams define inverted V guides, the truck having wheels resting on the inverted V guides and having an upper deck on which the object to be ground can be placed.

* * * * *